US006244306B1

(12) United States Patent
Troughton

(10) Patent No.: US 6,244,306 B1
(45) Date of Patent: Jun. 12, 2001

(54) PAPERMAKER'S FORMING FABRIC

(75) Inventor: Brian Herbert Pike Troughton, Herne Bay (GB)

(73) Assignee: Weavexx Corporation, Wake Forest, NC (US)

( * ) Notice: Subject to any disclaimer, the term of this patent is extended or adjusted under 35 U.S.C. 154(b) by 0 days.

(21) Appl. No.: 09/579,549

(22) Filed: May 26, 2000

(51) Int. Cl.[7] ..... D03D 23/00; D03D 25/00

(52) U.S. Cl. ..... 139/383 A; 139/383 B; 139/383 R

(58) Field of Search ..... 139/383 A, 383 B, 139/383 R, 408, 411, 412

(56) References Cited

U.S. PATENT DOCUMENTS

| | | | |
|---|---|---|---|
| Re. 33,195 | 4/1990 | McDonald et al. | 139/425 A |
| Re. 35,777 | 4/1998 | Givin | 139/383 A |
| 2,172,430 | 9/1939 | Barrell | 139/383 |
| 2,554,034 | 5/1951 | Koester et al. | 139/426 |
| 3,094,149 | 6/1963 | Keily | 139/383 |

(List continued on next page.)

FOREIGN PATENT DOCUMENTS

| | | | |
|---|---|---|---|
| 1115177 | 12/1981 | (CA) | 139/58 |
| 2-277848 | 11/1990 | (CN) | D03D/15/00 |
| 454 092 | 12/1927 | (DE) . | |
| 33 29 740 | 3/1985 | (DE) | D03D/11/00 |
| 0 048 962 | 9/1981 | (EP) | D03D/1/00 |
| 0 158 710 | 10/1984 | (EP) | D03D/1/00 |
| 0 185 177 | 10/1985 | (EP) | D03D/11/00 |
| 0 224 276 | 12/1986 | (EP) . | |
| 0 264 881 | 10/1987 | (EP) | D21F/1/00 |
| 0 269 070 | 11/1987 | (EP) | D03D/11/00 |

(List continued on next page.)

OTHER PUBLICATIONS

Warren, C.A., "The Importance of Yarn Properties in Wet–End Wire Construction," Seminar, The Theory of Water Removal, Dec. 12, 1979.

International Search Report for PCT Application No. PCT/US97/18629.

Rule 132 Declaration of Robert G. Wilson (Jun. 26, 1997).

*Primary Examiner*—John J. Calvert
*Assistant Examiner*—Robert H. Muromoto, Jr.
(74) *Attorney, Agent, or Firm*—Myers Bigel Sibley & Sajovec

(57) ABSTRACT

A triple layer papermaker's fabric includes: a set of top machine direction yarns; a set of top cross machine direction yarns interwoven with the top machine direction yarns to form a top fabric layer; a set of bottom machine direction yarns; a set of bottom machine direction yarns interwoven with the bottom machine direction yarns to form a bottom fabric layer; and a plurality of stitching yarns interwoven with the top and bottom fabric layers. The bottom machine direction yarns and cross machine direction yarns are interwoven in a series of repeat units in which the bottom machine direction yarns pass below two nonadjacent bottom cross machine direction yarns to form bottom machine direction knuckles, and in which pairs of bottom machine direction yarns separated from one another by one or two bottom machine direction yarns form bottom machine direction knuckles under a common bottom cross machine direction yarn. In this configuration, the bottom machine direction knuckles of a pair tend to bow toward one another, effectively lengthening floats present on either side of these knuckles. The increased length offers more bottom CMD yarn contact area to serve as a wear surface. In addition, the presence of these two bottom MD knuckles in close proximity can exert significant force on the common bottom CMD yarn, thereby causing it to crimp substantially. As a result of this crimping force, larger (and, in turn, more wearresistant) bottom CMD yarns can be employed.

29 Claims, 14 Drawing Sheets

U.S. PATENT DOCUMENTS

| | | | | |
|---|---|---|---|---|
| 3,325,909 | | 6/1967 | Clark | 34/95 |
| 4,093,512 | | 6/1978 | Fleischer | 162/348 |
| 4,182,381 | | 1/1980 | Gisbourne | 139/383 A |
| 4,244,543 | | 1/1981 | Ericson | 248/55 |
| 4,289,173 | | 9/1981 | Miller | 139/383 A |
| 4,290,209 | | 9/1981 | Buchanan et al. | 34/123 |
| 4,414,263 | | 11/1983 | Miller et al. | 428/234 |
| 4,438,788 | | 3/1984 | Harwood | 139/383 A |
| 4,452,284 | | 6/1984 | Eckstein et al. | 139/383 A |
| 4,453,573 | | 6/1984 | Thompson | 139/383 A |
| 4,501,303 | | 2/1985 | Osterberg | 139/425 A |
| 4,515,853 | | 5/1985 | Borel | 428/257 |
| 4,529,013 | | 7/1985 | Miller | 139/383 A |
| 4,564,052 | | 1/1986 | Borel | 139/425 A |
| 4,592,395 | | 6/1986 | Borel | 139/383 A |
| 4,592,396 | | 6/1986 | Borel et al. | 139/425 |
| 4,605,585 | | 8/1986 | Johansson | 428/224 |
| 4,611,639 | | 9/1986 | Bugge | 139/383 A |
| 4,621,663 | | 11/1986 | Malmendier | 139/383 A |
| 4,633,596 | | 1/1987 | Josef | 34/116 |
| 4,636,426 | | 1/1987 | Fleischer | 428/224 |
| 4,642,261 | | 2/1987 | Fearnhead | 428/225 |
| 4,676,278 | | 6/1987 | Dutt | 139/383 A |
| 4,705,601 | | 11/1987 | Chiu | 162/348 |
| 4,709,732 | | 12/1987 | Kinnunen | 139/383 A |
| 4,729,412 | | 3/1988 | Bugge | 139/383 A |
| 4,731,281 | | 3/1988 | Fleischer et al. | 428/196 |
| 4,739,803 | | 4/1988 | Borel | 139/383 A |
| 4,755,420 | | 7/1988 | Baker et al. | 428/222 |
| 4,759,975 | | 7/1988 | Sutherland et al. | 428/234 |
| 4,815,499 | | 3/1989 | Johnson | 139/383 |
| 4,815,503 | | 3/1989 | Borel | 139/383 A |
| 4,909,284 | | 3/1990 | Kositzke . | |
| 4,934,414 | | 6/1990 | Borel | 139/383 A |
| 4,941,514 | | 7/1990 | Taipale | 139/383 A |
| 4,942,077 | | 7/1990 | Wendt et al. | 428/152 |
| 4,945,952 | | 8/1990 | Vöhringer | 139/383 |
| 4,967,805 | | 11/1990 | Chiu et al. | 139/383 |
| 4,987,929 | | 1/1991 | Wilson | 139/383 A |
| 4,989,647 | | 2/1991 | Marchand | 139/383 A |
| 4,989,648 | | 2/1991 | Tate et al. | 139/383 |
| 4,998,568 | | 3/1991 | Vohringer | 139/383 A |
| 4,998,569 | | 3/1991 | Tate | 139/383 A |
| 5,022,441 | * | 6/1991 | Tate et al. | 139/383 A |
| 5,025,839 | | 6/1991 | Wright | 139/383 A |
| 5,067,526 | * | 11/1991 | Herring | 139/383 A |
| 5,074,339 | | 12/1991 | Vohringer | 139/383 A |
| 5,084,326 | | 1/1992 | Vohringer | 428/194 |
| 5,092,372 | | 3/1992 | Fitzka et al. | 139/383 A |
| 5,101,866 | | 4/1992 | Quigley | 139/383 |
| 5,116,478 | | 5/1992 | Tate et al. | 162/358 |
| 5,152,326 | | 10/1992 | Vohringer | 139/383 A |
| 5,158,118 | | 10/1992 | Tate et al. | 139/383 A |
| 5,219,004 | | 6/1993 | Chiu | 139/383 A |
| 5,228,482 | | 7/1993 | Fleischer | 139/383 A |
| 5,358,014 | | 10/1994 | Kovar | 139/383 A |
| 5,421,374 | | 6/1995 | Wright | 139/383 A |
| 5,421,375 | | 6/1995 | Praetzel | 139/383 A |
| 5,429,686 | | 7/1995 | Chiu et al. | 139/383 |
| 5,449,026 | | 9/1995 | Lee | 139/383 A |
| 5,454,405 | | 10/1995 | Hawes | 139/383 A |
| 5,456,293 | | 10/1995 | Ostermayer et al. | 139/383 A |
| 5,465,764 | * | 11/1995 | Eschmann et al. | 139/383 A |
| 5,482,567 | | 1/1996 | Barreto | 139/383 A |
| 5,487,414 | | 1/1996 | Kuji et al. | 139/383 |
| 5,518,042 | | 5/1996 | Wilson | 139/383 A |
| 5,520,225 | | 5/1996 | Quigley et al. | 139/383 A |
| 5,542,455 | | 8/1996 | Ostermayer et al. | 139/383 A |
| 5,555,917 | | 9/1996 | Quigley | 139/383 A |
| 5,564,475 | | 10/1996 | Wright | 139/383 A |
| 5,641,001 | | 6/1997 | Wilson | 139/383 A |
| 5,651,394 | | 7/1997 | Marchand | 139/383 |
| 5,709,250 | | 1/1998 | Ward et al. | 139/383 A |
| 5,746,257 | | 5/1998 | Fry | 139/383 AA |
| 5,826,627 | | 10/1998 | Seabrook et al. | 139/383 A |
| 5,881,764 | | 3/1999 | Ward | 139/383 A |
| 5,937,914 | | 8/1999 | Wilson | 139/383 A |
| 5,967,195 | | 10/1999 | Ward | 138/383 |
| 5,983,953 | | 11/1999 | Wilson | 139/383 |
| 6,123,116 | * | 9/2000 | Ward et al. | 139/383 A |
| 6,158,478 | * | 12/2000 | Lee et al. | 139/383 A |

FOREIGN PATENT DOCUMENTS

| | | | |
|---|---|---|---|
| 0 284 575 | 2/1988 | (EP) | D21F/1/00 |
| 0 283 181 | 3/1988 | (EP) | D21F/1/00 |
| 0 350 673 | 6/1989 | (EP) | D21F/1/00 |
| 0 048 849 A2 | 5/1990 | (EP) | D21F/1/00 |
| 0 048 849 A3 | 5/1990 | (EP) . | |
| 0 672 782 | 3/1995 | (EP) | D21F/1/00 |
| 0 794 283 A1 | 9/1997 | (EP) | D21F/1/00 |
| 2 597 123 | 4/1986 | (FR) | D03D/11/00 |
| 8605115 | 4/1986 | (FR) . | |
| 2157328A | 10/1985 | (GB) | D03D/1/00 |
| 2245006 | 2/1991 | (GB) | D03D/11/00 |
| 8-158285 | 12/1994 | (JP) . | |
| 9-41282 | 7/1995 | (JP) . | |
| 9-87990 | 9/1995 | (JP) . | |
| WO 86/00099 | 1/1986 | (WO) | D21F/1/00 |
| WO 89/09848 | 4/1989 | (WO) | D03D/23/00 |
| WO 93/10304 | 11/1992 | (WO) | D21F/1/10 |

* cited by examiner 22
82
114
102

24
84
120
108

26
86
114
106

28
88
120
112

30
90
118
106

32
92
112
104

34
94
118
110

36
96
116
104

38
98
110
102

40
100
116
108

401

420
424
402

426
430
404

420
432
406

422
426
408

428
432
410

422
434
412

424
428
414

430
434
416

501

530
534
502

540
544
504

530
550
506

536
540
508

546
550
510

532
536
512

542
546
514

532
552
516

538
542
518

548
552
520

534
538
522

544
548
524

601

628
636
602

624
632
604

620
628
606

624
634
608

620
630
610

626
634
612

622
630
614

626
636
616

622
632
618

PAPERMAKER'S FORMING FABRIC

FIELD OF THE INVENTION

This invention relates generally to woven fabrics, and relates more specifically to woven fabrics for papermakers.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric", provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (ie., the "machine side") of the upper run of the fabric.

After leaving the forming section, the paper web is transferred to a press section of the paper machine, in which it is passed through the nips of one or more pairs of pressure rollers covered with another fabric, typically referred to as a "press felt." Pressure from the rollers removes additional moisture from the web; the moisture removal is often enhanced by the presence of a "batt" layer on the press felt. The paper is then conveyed to a drier section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing a pin-seamable flap on each end or a special foldback, then reweaving these into pin-seamable loops. In a flat woven papermaker's fabric, the warp yarns extend in the machine direction and the filling yarns extend in the cross machine direction. In the second technique, fabrics are woven directly in the form of a continuous belt with an endless weaving process. In the endless weaving process, the warp yarns extend in the cross machine direction and the filling yarns extend in the machine direction. As used herein, the terms "machine direction" (MD) and "cross machine direction" (CMD) refer, respectively, to a direction aligned with the direction of travel of the papermaker's fabric on the papermaking machine, and a direction parallel to the fabric surface and traverse to the direction of travel. Both weaving methods described hereinabove are well known in the art, and the term "endless belt" as used herein refers to belts made by either method.

Effective sheet and fiber support and an absence of wire marking are typically important considerations in papermaking, especially for the forming section of the papermaking machine, where the wet web is initially formed. Wire marking is particularly problematic in the formation of fine paper grades, as it can affect a host of paper properties, such as sheet mark, porosity, "see through" and pin holing. Wire marking is typically the result of individual cellulosic fibers being oriented within the paper web such that their ends reside within gaps between the individual threads or yarns of the forming fabric. This problem is generally addressed by providing a permeable fabric structure with a coplanar surface that allows paper fibers to bridge adjacent yarns of the fabric rather than penetrate the gaps between yarns. As used herein, "coplanar" means that the upper extremities of the yarns defining the paperforming surface are at substantially the same elevation, such that at that level there is presented a substantially "planar" surface. Accordingly, fine paper grades intended for use in quality printing, carbonizing, cigarettes, electrical condensers, and like grades of fine paper have typically heretofore been formed on very finely woven or fine wire mesh forming fabrics.

Typically, such finely woven fabrics include at least some relatively small diameter machine direction or cross machine direction yarns. Regrettably, however, such yarns tend to be delicate, leading to a short surface life for the fabric. Moreover, the use of smaller yarns can also adversely effect the mechanical stability of the fabric (especially in terms of skew resistance, narrowing propensity and stiffness), which may negatively impact both the service life and the performance of the fabric.

To combat these problems associated with fine weaves, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paper side fabric layer and a separate, coarser machine side fabric layer. In these fabrics, which are part of a class of fabrics generally referred to as "triple layer" fabrics, the two fabric layers are typically bound together by separate stitching yarns. As double and triple layer fabrics include additional sets of yarn as compared to single layer fabrics, these fabrics typically have a higher "caliper" (i.e., they are thicker than) comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, and U.S. Pat. Nos. 5,437,315 and 5,967,195 to Ward.

Although these fabrics have performed successfully, they have some potential shortcomings. For example, the coarser CMD yarns used in the bottom layer of the fabric typically have long "floats" (segments that span multiple adjacent MD yarns in the weave pattern) that contact the papermaking machine and, accordingly, are subjected to a large degree of wear. On one hand, this is desirable, as it protects the machine direction yarns (which are forced to absorb and withstand much of the tension present in the fabric during operation); such a configuration does indicate that the cross-machine direction yarns that contact the paper machine should be wear-resistant. On the other hand, the CMD yarns should not be of a size or woven in a configuration that negatively impacts papermaking. As such, a weave pattern that can improve the wear resistance of the CMD yarns while still providing acceptable papermaking properties is desirable.

SUMMARY OF THE INVENTION

In view of the foregoing, it is an object of the present invention to provide a paperniaker's fabric suitable for forming paper.

It is another object of the present invention to provide a forming fabric that addresses the wear issues of the bottom layer CMD yarns while still providing suitable papermaking properties.

These and other objects are satisfied by the present invention, which is directed to a papermaker's fabric that may have increased wear properties. The triple layer fabric comprises: a set of top machine direction yarns; a set of top cross machine direction yarns interwoven with the top machine direction yarns to form a top fabric layer; a set of bottom machine direction yarns; a set of bottom machine direction yarns interwoven with the bottom machine direction yarns to form a bottom fabric layer; and a plurality of stitching yarns interwoven with the top and bottom fabric layers. The bottom machine direction yarns and cross machine direction yarns are interwoven in a series of repeat units in which the bottom machine direction yarns pass below two nonadjacent bottom cross machine direction yarns to form bottom machine direction knuckles, and in which pairs of bottom machine direction yarns separated from one another by one or two bottom machine direction yarns form bottom machine direction knuckles under a common bottom cross machine direction yarn.

In this configuration, the bottom machine direction knuckles of a pair tend to bow toward one another, effectively lengthening floats present on either side of these knuckles. The increased length offers more bottom CMD yarn contact area to serve as a wear surface. In addition, the presence of these two bottom MD knuckles in close proximity can exert significant force on the common bottom CMD yarn, thereby causing it to crimp substantially. As a result of this crimping force, larger (and, in turn, more wear-resistant) bottom CMD yarns can be employed.

BRIEF DESCRIPTION OF THE FIGURES

FIGS. 8A–8L are cross-sectional views of MD yarns of a bottom layer of a sixteen harness triple layer fabric of the present invention; wherein eight harnesses are used to form the paper side of the fabric and eight harnesses are used to form the machine side of the fabric.

DETAILED DESCRIPTION OF THE INVENTION

The present invention will now be described more particularly hereinafter with reference to the accompanying drawings, in which embodiments of the invention are shown. The invention, however, be embodied in many different forms and is not limited to the embodiments set forth herein; rather, these embodiments are provided so that the disclosure will fully convey the scope of the invention to those skilled in the art. Like numbers refer to like components throughout. The dimensions and thicknesses for some components and layers may be exaggerated for clarity.

Figure 1:
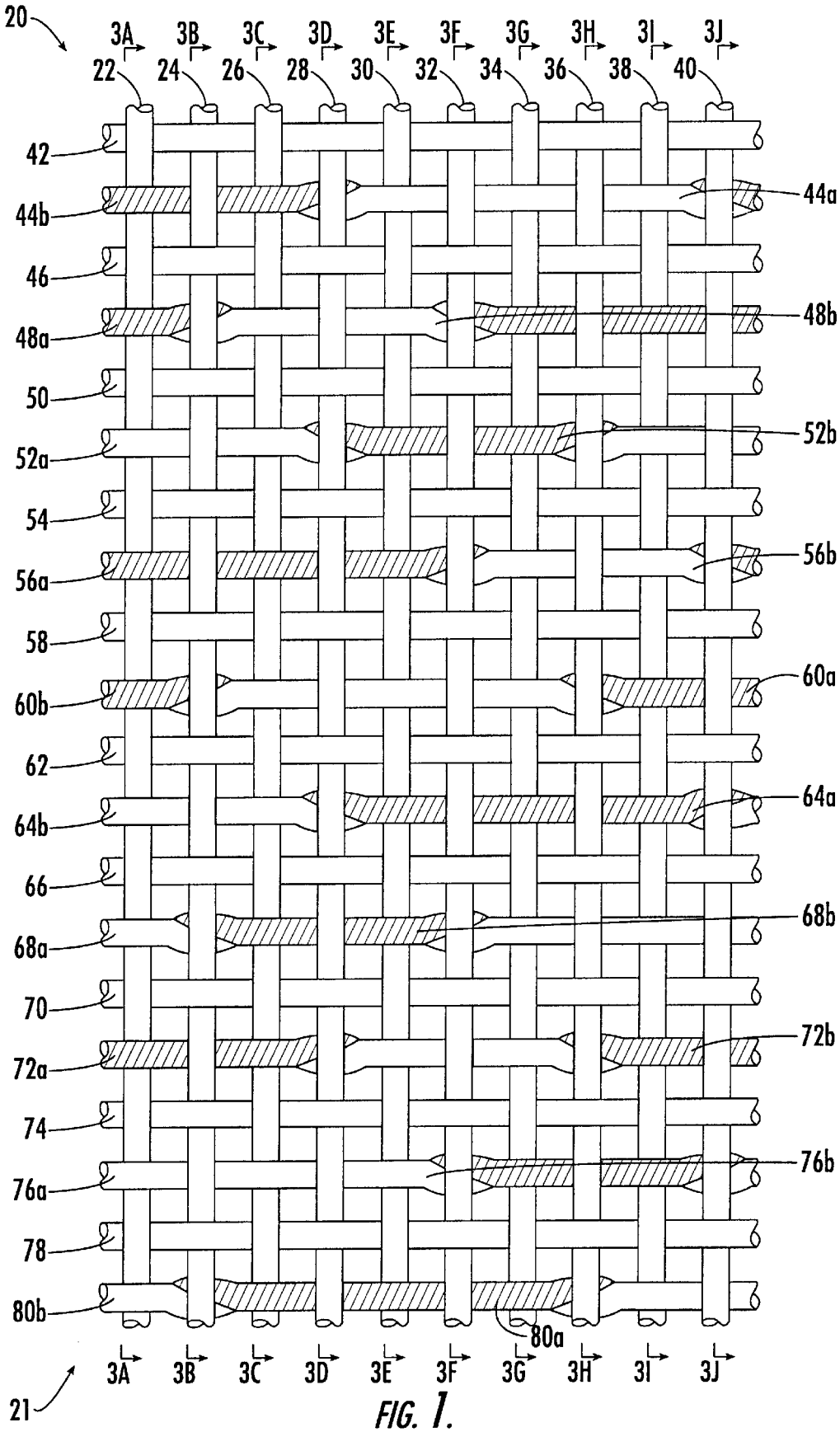
FIG. 1 is a top view of a triple layer forming fabric of the present invention.
Figure 2:
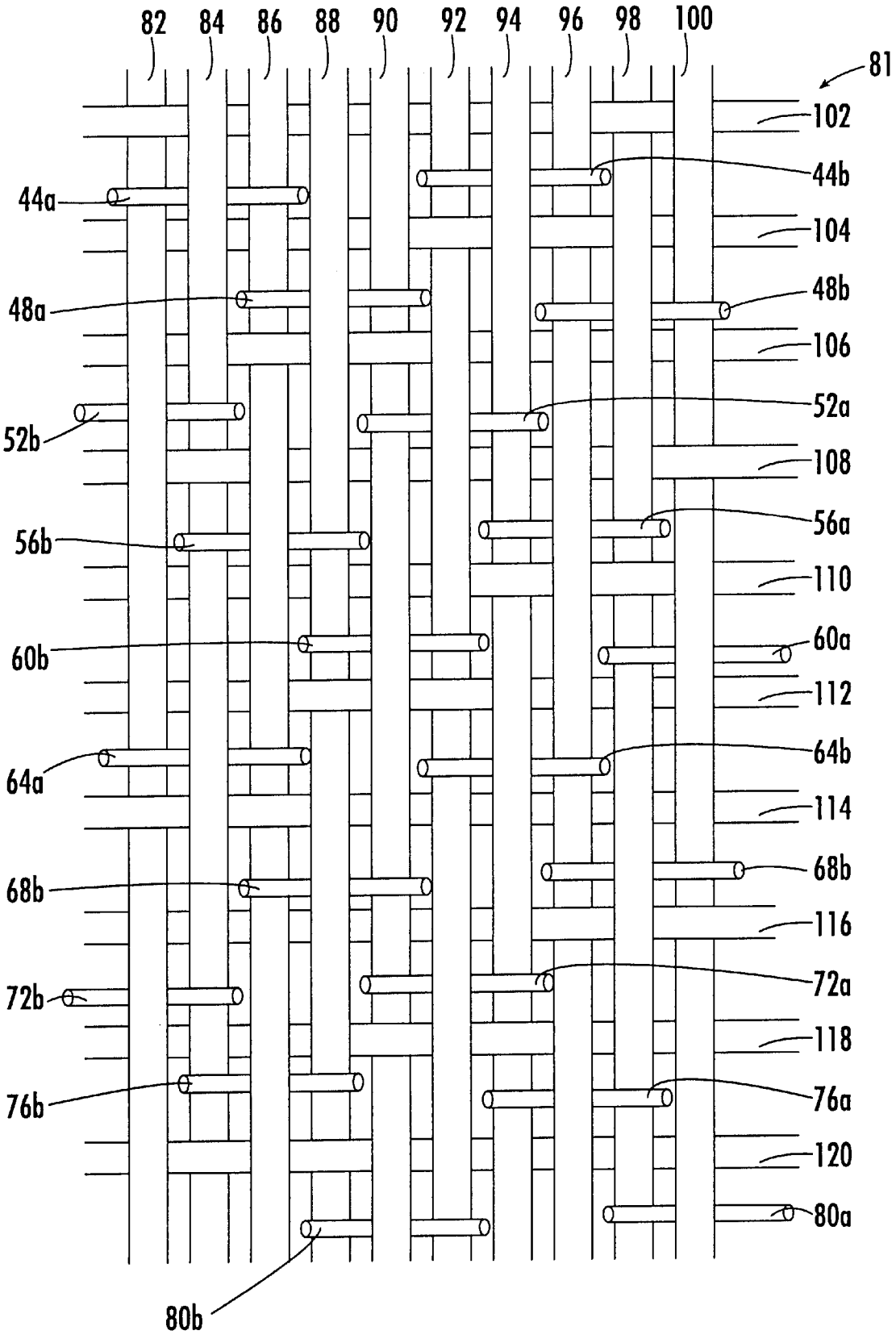
FIG. 2 is a top section view of the fabric of FIG. 1 with the top layer removed.
Figures 3A, 3B, 3C, 3D, 3E, 3F, 3G, 3H, 3I, 3J:
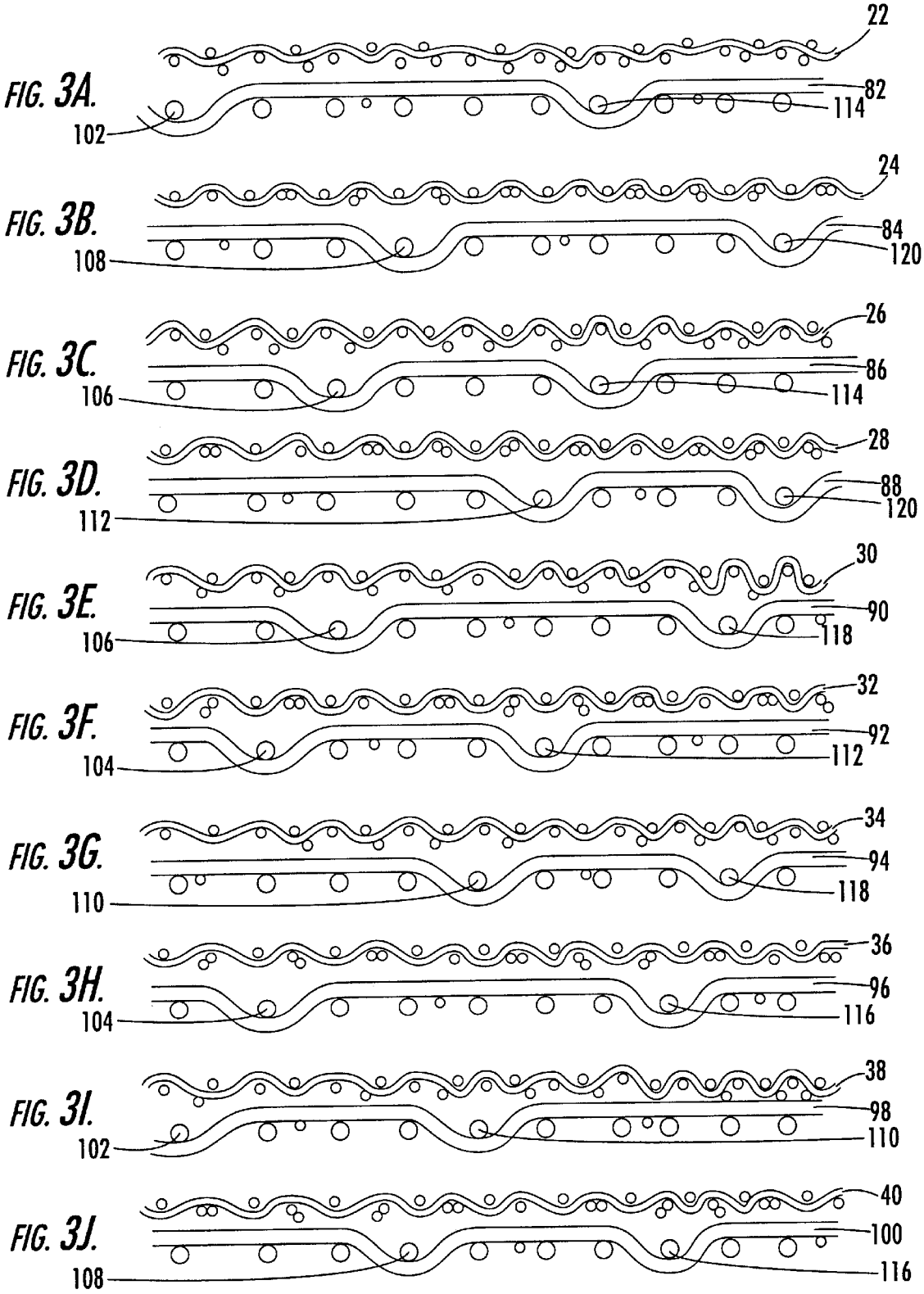
FIGS. 3A–3J are section views taken along lines 3A—3A through 3J—3J of FIG. 1.

A twenty harness triple layer forming fabric, generally designated at 20, is illustrated in FIGS. 1A and 1B, in which a single repeat unit of the fabric 20 is shown. As seen in FIG. 1A, the repeat unit of the fabric 20 includes a top layer 21 and a bottom layer 81. The top layer 21 includes ten top MD yarns 22, 24, 26, 28, 30, 32, 34, 36, 38 and 40 and ten top CMD yarns 42, 46, 50, 54, 58, 62, 66, 70, 74 and 78. These are interwoven such that each top CMD yarn passes over and beneath top MD yarns in an alternating fashion, with each top CMD yarn passing over and under the same top MD yarns. For example, top CMD yarn 42 passes under top MD yarn 22, over top MD yarn 24, under top MD yarn 26, over top MD yarn 28 and so on until it passes over top MD yarn 40. Similarly, top CMD yarn 46 passes under top MD yarn 22, over top MD yarn 24, under top MD yarn 26, over top MD yarn 28 and so on until it passes over top MD yarn 40.

Referring now to FIG. 1B, the repeat unit of the fabric 20 also includes the bottom layer 81. The repeat unit includes ten bottom MD yarns 82, 84, 86, 88, 90, 92, 94, 96, 98 and 100 which are interwoven with ten bottom CMD yarns 102, 104, 106, 108, 110, 112, 114, 116, 118 and 120. Each of the bottom MD and CMD yarns is positioned substantially directly below a corresponding top MD or CMD yarn. The bottom MD yarns are interwoven with the bottom CMD yarns in a pattern in which each bottom MD yarn passes over five adjacent bottom CMD yarns, below the next bottom CMD yarn, over the next three adjacent bottom CMD yarns, and below the next bottom CMD yarn. For example, bottom MD yarn 88 passes above bottom CMD yarns 102, 104, 106, 108, 110, below bottom CMD yarn 112, above bottom CMD yarns 114, 116, 118, and below bottom CMD yarn 120. The other bottom MD yarns follow a similar "over 5/under 1/over 3/under 1" weave pattern, but each is offset in its weaving sequence from its nearest bottom MD yarn neighbors by three bottom CMD yarns. Consequently, bottom MD yarn 90 (which is adjacent bottom CMD yarn 88) passes above bottom CMD yarns 102, 104, below bottom CMD yarn 106, above bottom CMD yarns 108, 110, 112, 114, 116, above bottom CMD yarn 118, and above bottom CMD yarn 120. Thus, the bottom MD "knuckle" formed by bottom MD yarn 90 as it passes below bottom CMD yarn 118 is offset from the bottom "knuckle" formed by bottom MD yarn 88 as it passes below bottom CMD yarn 112 by three bottom MD yarns.

The top layer 21 also includes portions of twenty stitching yarns, designated herein as pairs 44*a*, 44*b*, 48*a*, 48*b*, 52*a*, 52*b*, 56*a*, 56*b*, 60*a*, 60*b*, 64*a*, 64*b*, 68*a*, 68*b*, 72*a*, 72*b*, 76*a*,

76*b* and 80*a*, 80*b*. The stitching yarns are positioned in pairs between adjacent top and bottom CMD yarns; there is no bottom CMD yarn below each stitching yarn pair so that space is present for the stitching yarn to stitch. For example, stitching yarns 44*a* and 44*b* are positioned between top CMD yarns 42 and 46. The stitching yarns interweave with the top MD yarns and bottom MD yarns to bind the top and bottom fabric layers together. It should be noted that, when the top and bottom fabric layers 21, 81 are joined, the top CMD yarns are positioned substantially directly above the bottom CMD yarns, such that space exists between adjacent bottom CMD yarns for the stitching yarns to stitch.

As can be seen in FIGS. 3A through 3J, corresponding pairs of stitching yarns interweave with the top MD yarns and bottom MD yarns in the following pattern. Each of the stitching yarns of the repeat unit can be subdivided into two portions: a fiber support portion which interweaves with the top MD yarns, and a binding portion which interweaves with a bottom MD yarn. These are separated at "transitional" top MD yarns, below which one stitching yarn of a pair crosses the other stitching yarn of the pair. The stitching yarns of each pair are interwoven relative to one another such that the fiber support portion of one yarn of the pair is positioned above the binding portion of the other yarn of the pair. The fiber support portion of the stitching yarn of each pair designated with an "a" (eg, 44*a*, 48*a*, 52*a*) interweaves in an alternating fashion with five top MD yarns (alternately passing over three top MD yarns and under two top MD yarns), and the other stitching yarn of the pair (those designated with a "b") passes over two top MD yarns while passing below a top MD yarn positioned between those two MD yarns. In its fiber support portion, each stitching yarn passes over top MD yarns that the top CMD yarns pass beneath, and passes below top MD yarns that each top CMD yarn passes over. In this manner, the stitching yarns and top CMD form a plain weave pattern with the top MD yarns on the papermaking (i.e., top surface )(see FIG. 1A). In its binding portion, each stitching yarn passes below one bottom MD yarn in the repeat unit such that an "over 4/under 1" pattern is established by the pair of stitching yarns on the bottom surface of the fabric 20 (se FIG. 1B). This configuration is discussed in greater detail in U.S. Pat. No. 5,967,195 to Ward, the disclosure of which is hereby incorporated herein by reference in its entirety.

Referring back to FIGS. 1A and 1B, pairs of stitching yarns that are positioned adjacent to and on opposite sides of a top or bottom CMD yarn are interwoven with the top or bottom MD yarns such that there is an offset of two MD yarns between such stitching yarn pairs. For example, stitching yarn 44*a* passes above top MD yarns 30, 34 and 38 and below bottom MD yarn 84. Stitching yarn 48*a* passes above top MD yarns 34, 38 and 22 (with top MD yarn 22 being a continuation of the pattern on the opposite side) and below bottom MD yarn 88. Thus, stitching yarn 44*a* is offset from stitching yarn 48a by two top and bottom MD yarns. This same two MD yarn offset is followed for the interweaving of the other stitching yarns.

It can also be seen in FIGS. 1A and 1B that the stitching yarns are interwoven with the top and bottom MD yarns as "reversed picks." This term is described in detail in U.S. Pat. No. 5,967,195 to Ward and need not be discussed further herein.

Figure 4A:
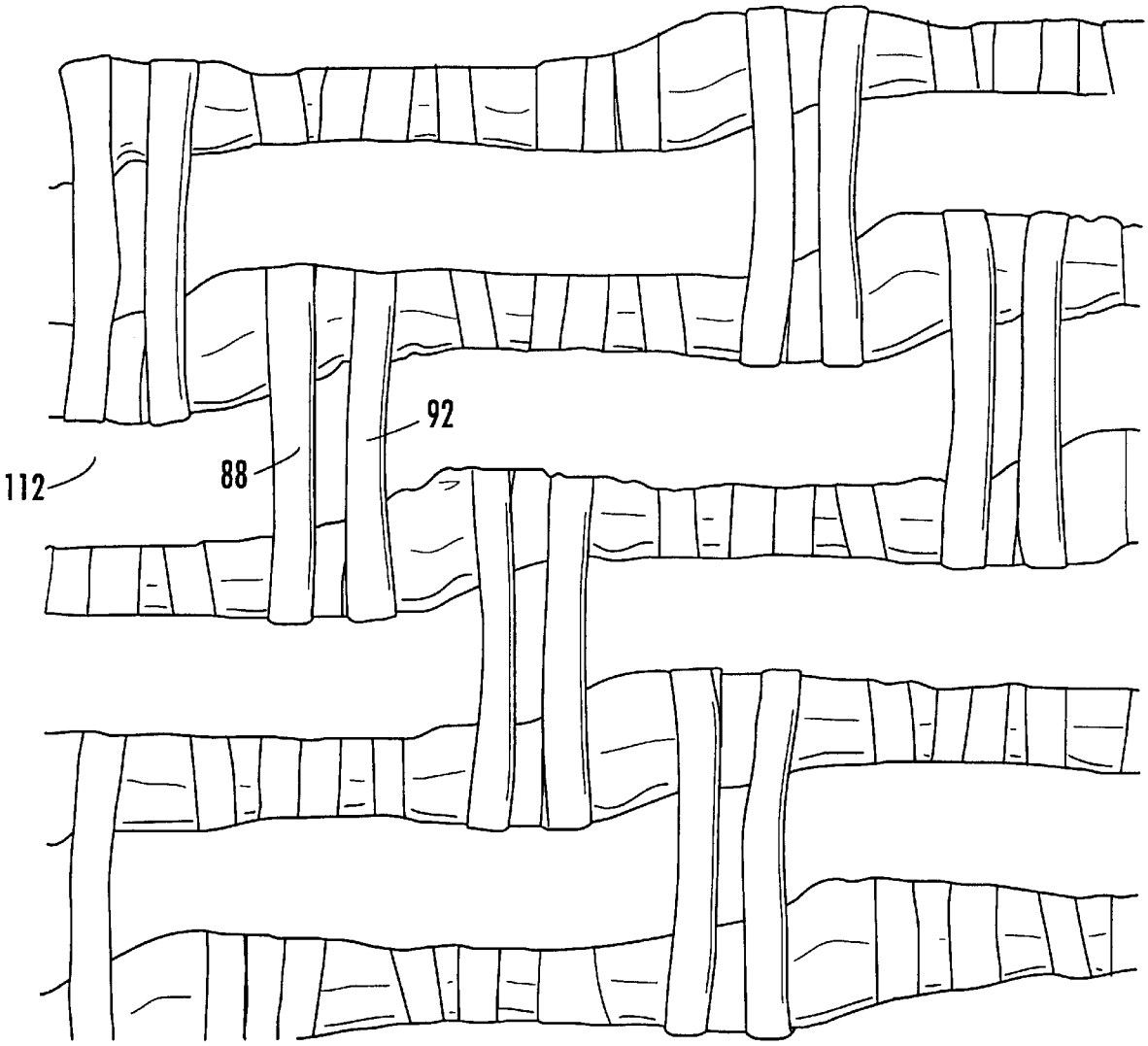
FIG. 4A is an enlarged bottom view of the fabric of FIG. 1 showing an "extended" bottom CMD yarn float.
Figure 4B:
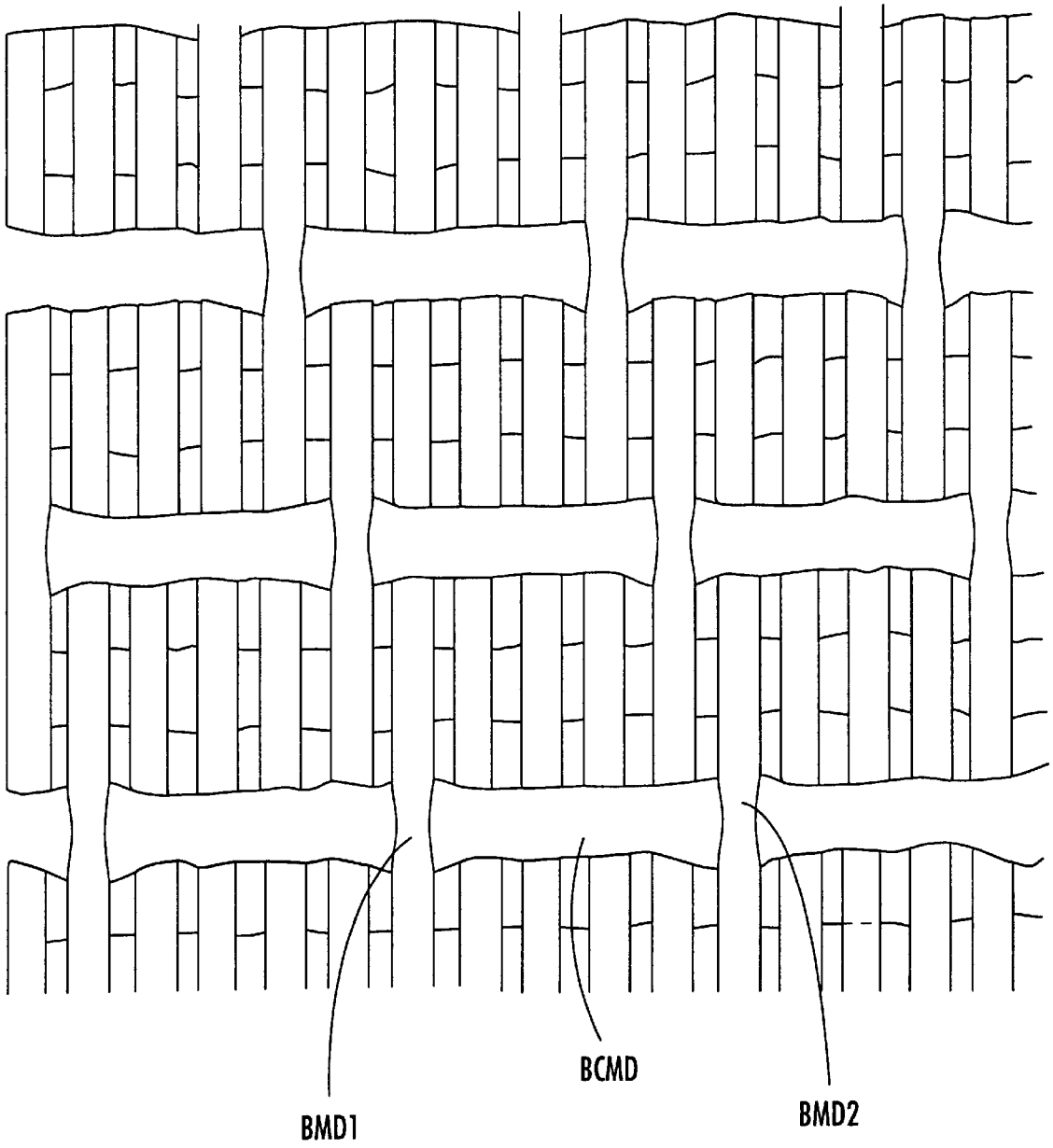
FIG. 4B is an enlarged bottom view of a prior art fabric shown for comparative purposes.
Figure 5:
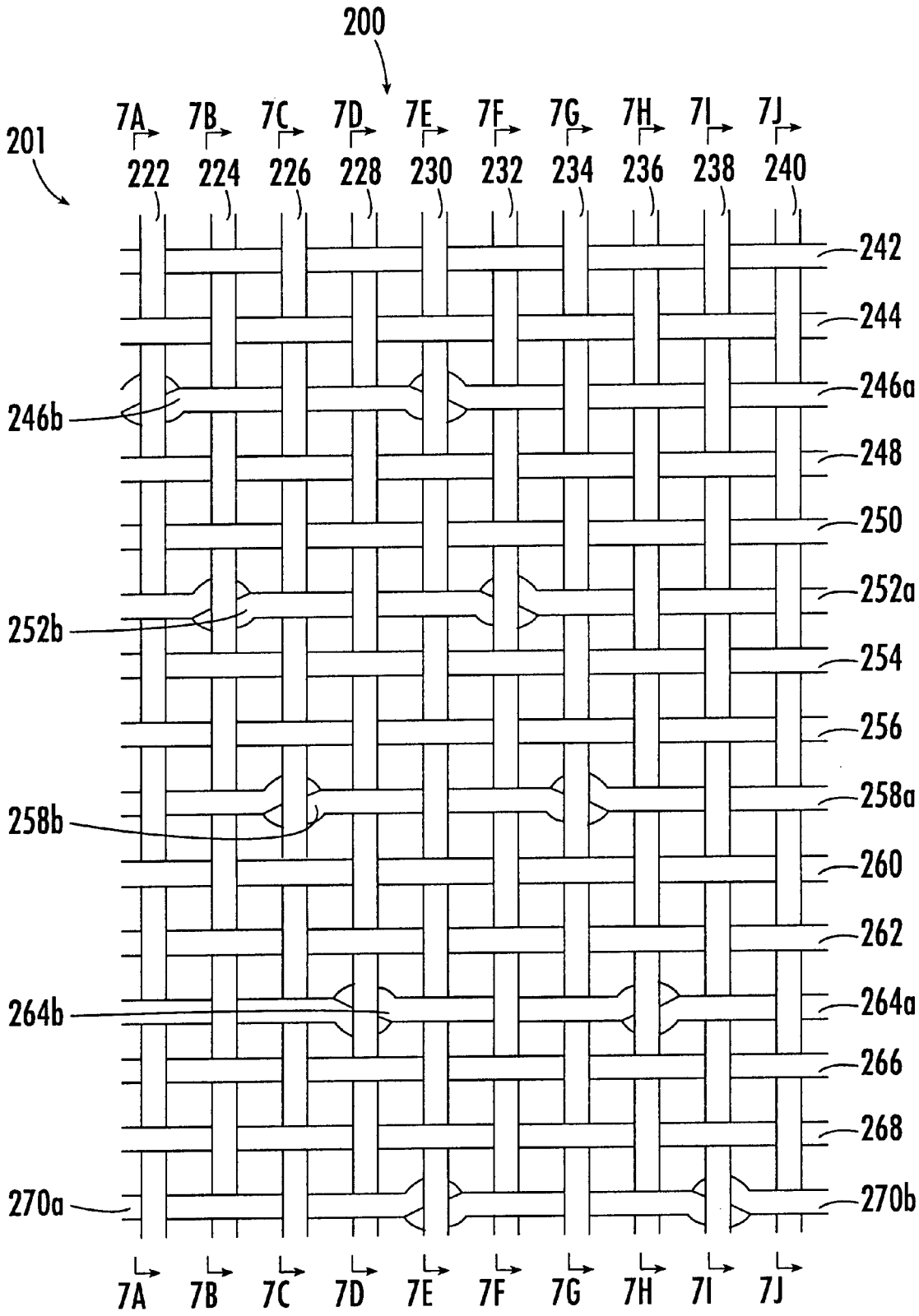
FIG. 5 is a top view of another embodiment of a triple layer forming fabric of the present invention.
Figure 6:
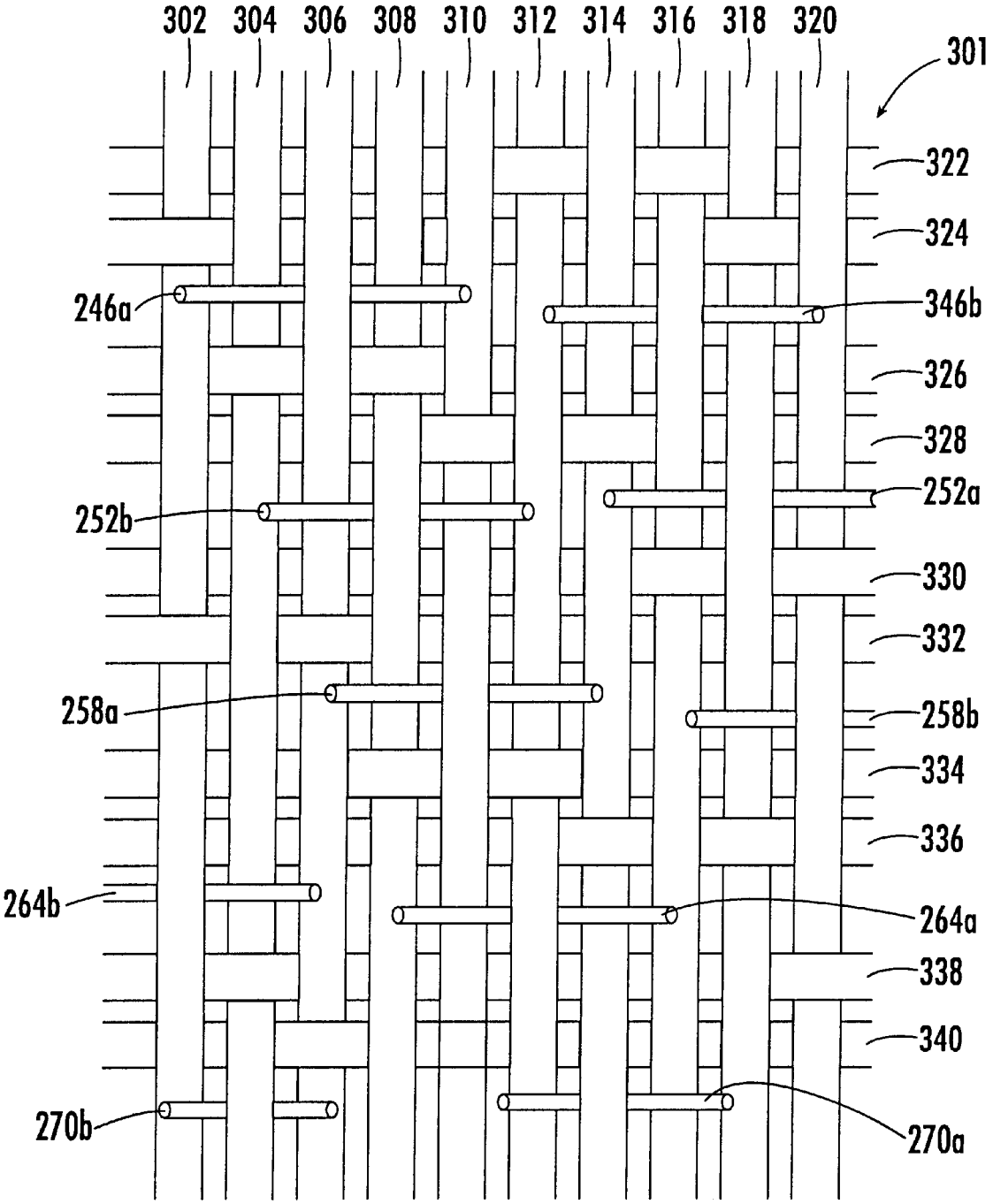
FIG. 6 is a top section view of the fabric of FIG. 5 with the top layer removed.
Figure 7A:
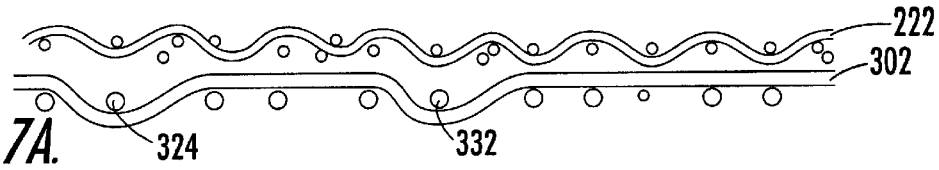
FIGS. 7A–7J are section views taken along lines 7A—7A through 7J—7J of FIG. 5.
Figure 7B:
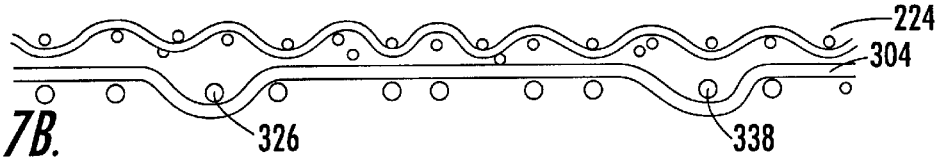
Figure 7C:
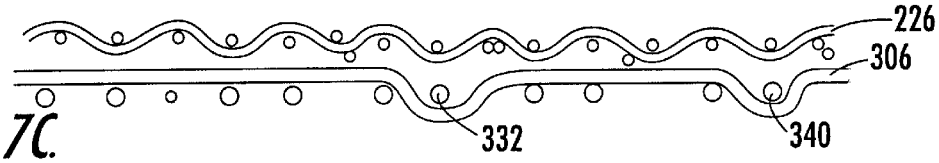
Figure 7D:
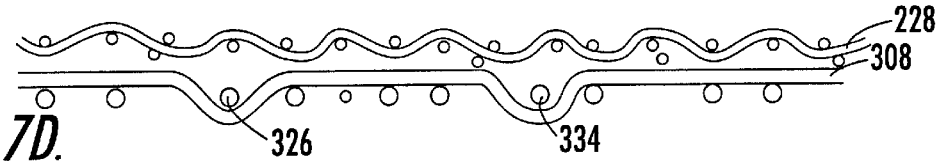
Figure 7E:
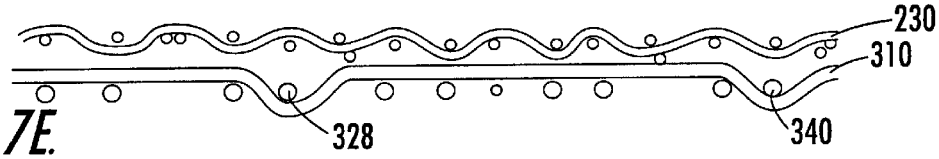
Figure 7F:
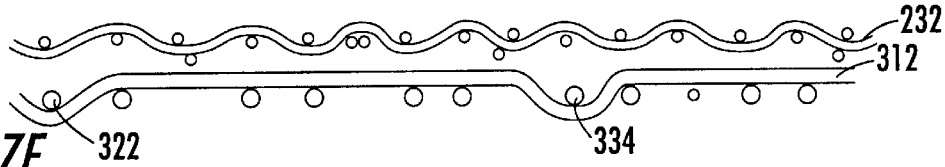
Figure 7G:
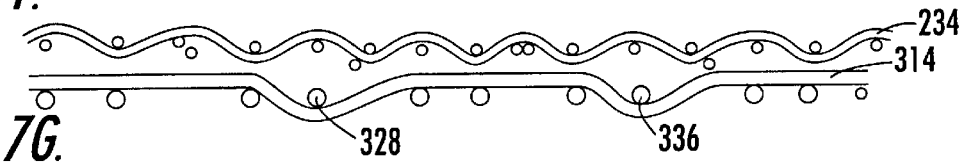
Figure 7H:
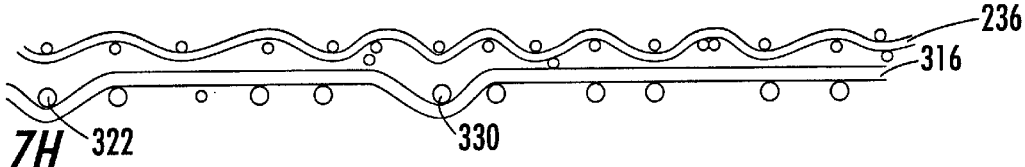
Figure 7I:
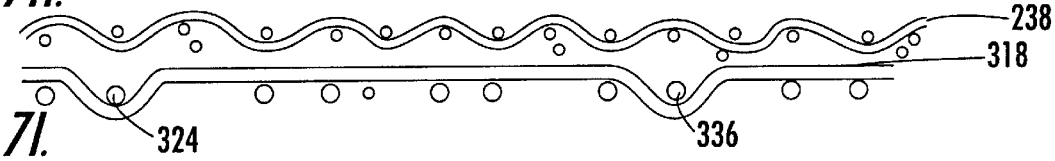
Figure 7J:
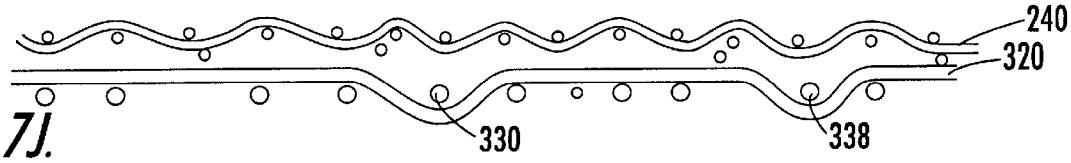
Figures 8A, 8B, 8C, 8D, 8E, 8F, 8G, 8H:
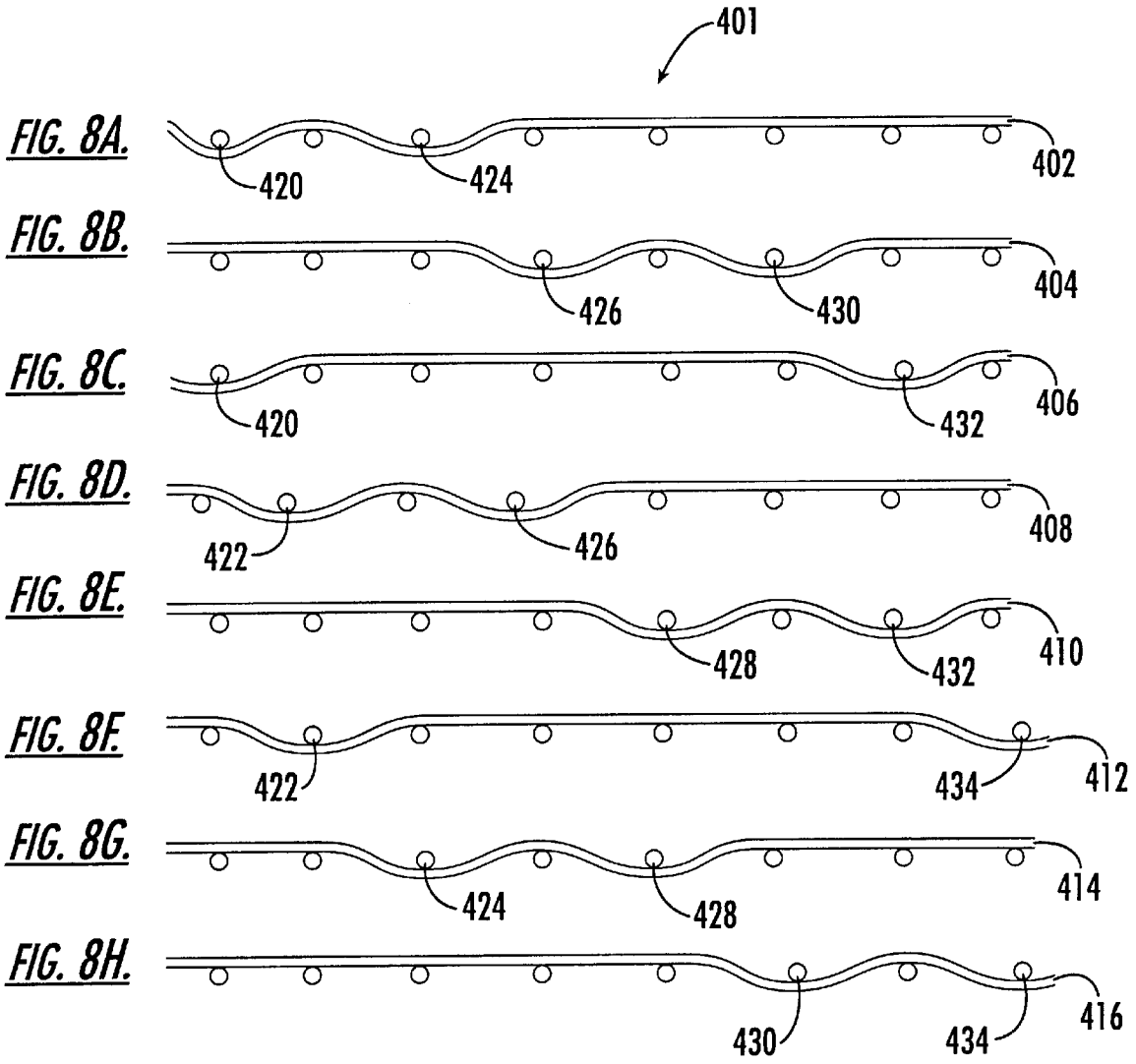
Figures 9A, 9B, 9C, 9D, 9E, 9F, 9G, 9H, 9I, 9J, 9K, 9L:
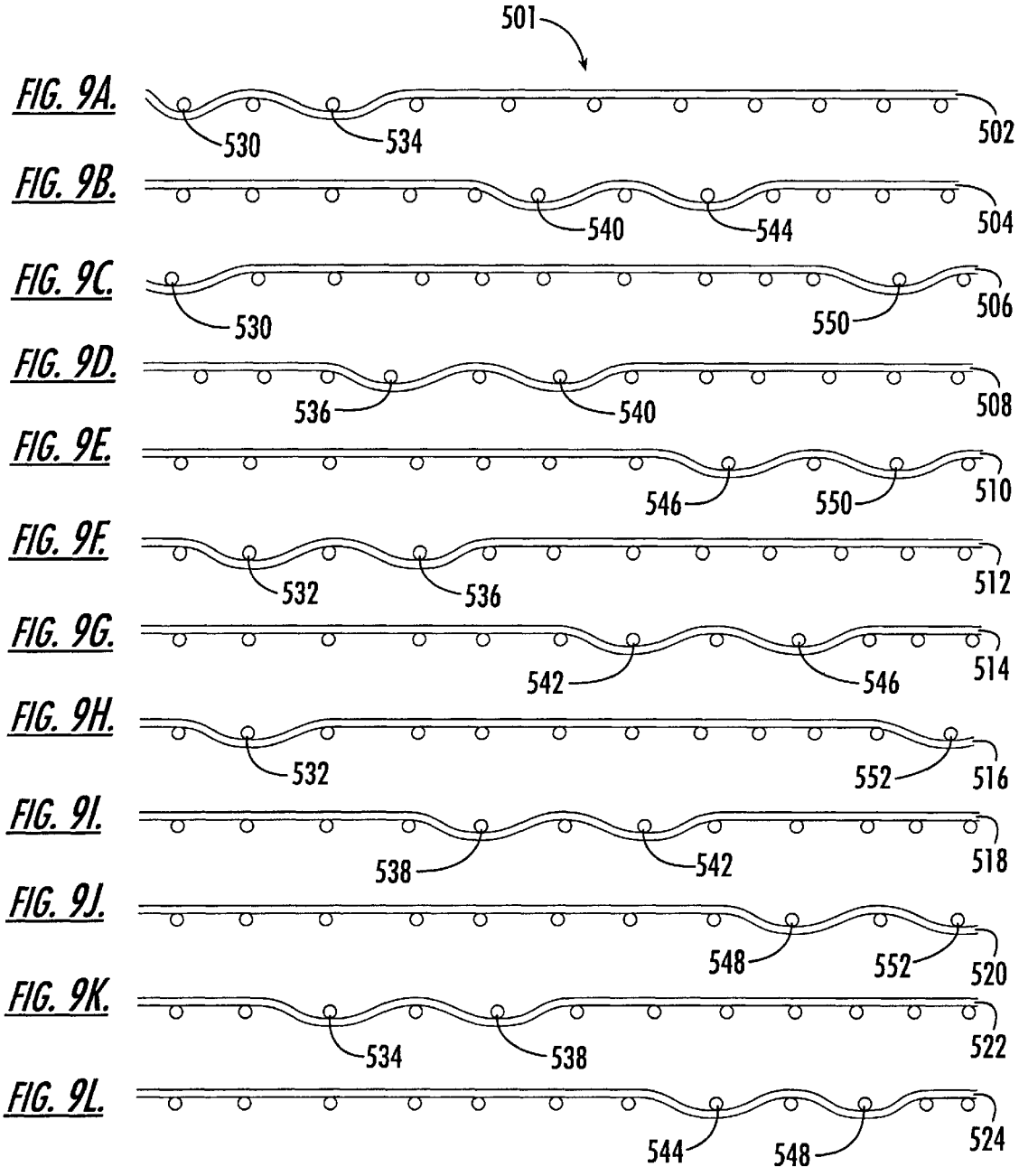
FIGS. 9A–9L are cross-sectional views of MD yarns of a bottom layer of a twenty-four harness triple layer fabric of the present invention, wherein twelve harnesses are used to form the paper side of the fabric and twelve harnesses are used to form the machine side of the fabric.
Figures 10A, 10B, 10C, 10D, 10E, 10F, 10G, 10H, 10I:
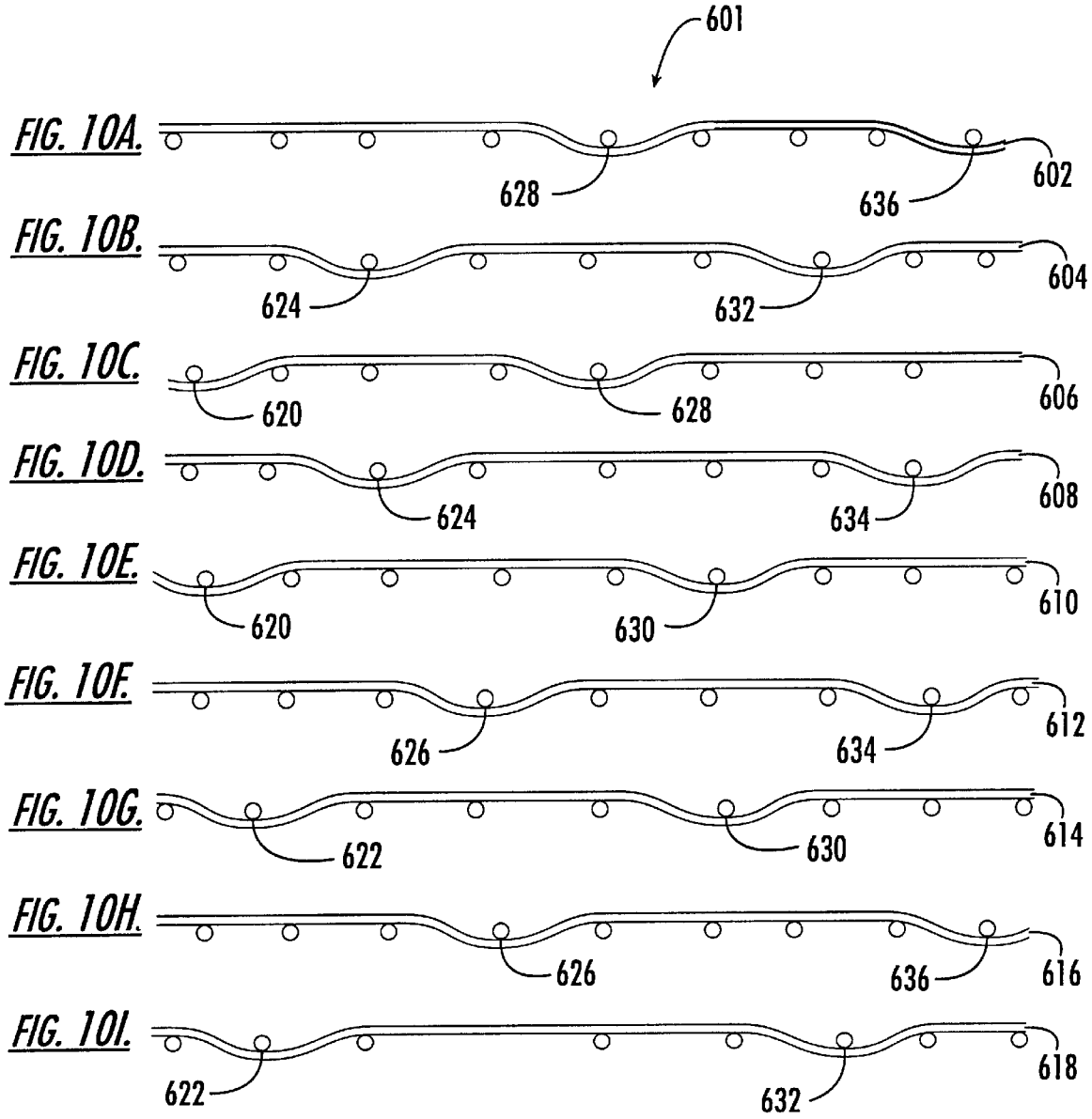
FIGS. 10A–10I are cross-sectional views of a bottom layer of an eighteen harness triple layer fabric of the present invention, wherein nine harnesses are used to form the paper side of the fabric, and nine harnesses are used to form the machine side of the fabric.

Notably, each of the bottom MD knuckles formed on the bottom surface of the bottom layer 81 by the bottom MD yarns is separated from another bottom MD yarn knuckle formed under the same bottom CMD yarn by one bottom MD yarn. It has been discovered that, in this configuration, the bottom MD yarn knuckles tend to bow toward one another. This effect is illustrated in FIG. 4A, which shows bottom MD yarns 88 and 92 as they form bottom MD knuckles below bottom CMD yarn 112 (MD yarns 88 and 92 are seen as passing above CMD yarn 112 in FIG. 4A because this is a bottom view of the fabric 20). Because these two knuckles are located near one another (i.e., separated by one bottom MD yarn), they impart sufficient force to the intersecting CMD yarn to cause considerable crimping. As seen in FIG. 4A, the crimping of the bottom CMD yarn 112 enables the bottom side MD knuckles to bow toward one another (see prior art fabric in FIG. 4B for purposes of comparison, as the bottom side knuckles BMD1 and BMD2 fail to bow toward one another). The result is an effective lengthening of the long (in this instance, 7 bottom MD yarns long) bottom CMD yarn float that is present between these bottom side MD yarn knuckle pairs. In some instances, the lengthening of the float that occurs can be as much as would be provided by an additional bottom MD yarn (in other words, in this configuration the 7 bottom MD yarn long float may be the length of an 8 bottom MD yarn long float in other fabrics). This increase in length can improve wear of the fabric, as more bottom CMD yarn surface may be exposed to the papermaking machine for wear resistance.

Another consequence of the arrangement of the bottom MD knuckles is that, when the bottom MD knuckles induce the aforementioned crimping of the bottom CMD yarn, they tend to recede somewhat toward the top layer. As the bottom MD knuckles are drawn toward the top layer, they are less exposed to the bottom wear surface of the bottom fabric layer 81. The additional crimping force present in the knuckle arrangement described herein enables the knuckles to induce crimping in larger diameter bottom CMD yarns (which tend to be stiffer) than may be the case for prior art fabrics. Consequently, higher diameter bottom CMD yarns (which tend to have better wear resistance than lower diameter yarns) can be employed.

It should also be noted that when a stitching yarn passes below a bottom MD yarn, it does so between two bottom CMD yarns that are forming bottom CMD long floats. In this position, the CMD yarns can protect the stitching yarns from contact with the paper machine and from the resultant wear.

Referring now to FIGS. 5, 6 and 7A–7J, an alternative embodiment of a triple layer fabric, designated broadly at 200, is illustrated therein. The triple layer fabric 200 includes a top layer 201 and a bottom layer 301. The top layer 201 includes ten top MD yarns 222, 224, 226, 228, 230, 232, 234, 236, 238 and 240 interwoven with ten top CMD yarns 242, 244, 248, 250, 254, 256, 260, 262, 266, and 268, as well as five pairs of stitching yarns 246*a*, 246*b*, 252*a*, 252*b*, 258*a*, 258*b*, 264*a*, 264*b*, and 270*a*, 270*b*. The top CMD yarns and stitching yarns are arranged such that a pair of stitching yarn follows every two top CMD yarns in a repeating pattern; for example, the top layer 201 sequentially includes top CMD yarn 242, top CMD yarn 244, stitching yarn pair 246*a*, 246*b*, top CMD yarn 248, top CMD yarn 250, stitching yarn pair 250*a*, 250*b*, and so on. The top CMD yarns and fiber support portions of the stitching yarns are interwoven with the top MD yarns to form a plain weave surface in much the same manner as that of the fabric 20 described above, although with stitching yarn pairs replacing only every third top CMD yarn.

The bottom layer 301 includes ten bottom MD yarns 302, 304, 306, 308, 310, 312, 314, 316, 318 and 320 interwoven with ten bottom CMD yarns 322, 324, 326, 328, 330, 332, 334, 336, 338 and 340. The weaving pattern of the bottom MD yarns relative to the bottom CMD yarns is identical to that described above for the fabric 20; namely, each bottom MD yarn follows an "over 5/under 1/over 3/under 1" pattern relative to the bottom CMD yarns, and adjacent MD yarns are offset from one another by three bottom CMD yarns. As a result, the characteristic bottom MD knuckles formed under a common bottom CMD yarn separated by one bottom MD yarn is also present in the bottom layer 301. Accordingly, the performance advantages discussed above for the embodiment of FIGS. 1 through 4 may also be achieved with the fabric 200.

When the bottom layer 301 is joined with the top layer 201, each of the bottom CMD yarns is positioned substantially directly below a corresponding top CMD yarn. There is no bottom CMD yarn positioned substantially directly below the stitching yarn pairs, thereby providing a space in which the stitching yarns can stitch below a bottom CMD yarn. Of course, those skilled in this art will appreciate that the fabric may have differing numbers of top and bottom CMD yarns in a repeat unit; for example, there may be 1.5, two or three times as many top CMD yarns as bottom CMD yarns. In addition, in some embodiments bottom CMD yarns may be present below the stitching yarn pairs; in such embodiments, it is preferred that the stitching yarns of a pair stitch on opposite sides of the underlining bottom CMD yarn.

Those skilled in this art will appreciate that, although the illustrated fabrics employ ten top MD yarns and ten bottom MD yarns (i.e., they are "twenty harness fabrics"), other numbers of top and bottom MD yarns may be employed in fabrics of the present invention. For example, fabrics employing eight, nine, eleven or even twelve top and bottom MD yarns may also be suitable for fabrics of the present invention. An example of this is illustrated in FIGS. 8A–8H, which show MD cross-sections of a bottom layer 401 of a 16 harness triple layer fabric (not shown in its entirety). In FIGS. 8A–8H, eight bottom MD yarns 402, 404, 406, 408, 410, 412, 414 and 416 interweave with eight bottom CMD yarns 420, 422, 424, 426, 428, 430, 432, and 434. As they interweave, each bottom MD yarn follows an "over 5/under 1/over 1/under 1" weave pattern relative to the bottom CMD yarns, with adjacent bottom MD yarns being offset from one another by these bottom CMD yarns.

As another example, FIGS. 9A–9L illustrate the MD yarns of a bottom layer 501 of a twenty-four harness triple layer fabric (not shown in its entirety), which includes twelve bottom MD yarns 502, 504, 506, 508, 510, 512, 514, 516, 518, 520, 522 and 524 interwoven with twelve bottom CMD yarns 530, 532, 534, 536, 538, 540, 542, 544, 546, 548, 550 and 552. As they interweave, each bottom MD yarn follows an "over 9/under 1/over 1/under 1" weave pattern relative to the bottom CMD yarns, with adjacent bottom MD yarns being offset from one another by five bottom CMD yarns.

As a further example, FIGS. 10A–10I illustrate the MD yarns of a bottom layer 601 of an eighteen harness triple layer fabric (not shown in its entirety), which includes nine bottom MD yarns 602, 604, 606, 608, 610, 612, 614, 616, and 618 interwoven with nine bottom CMD yarns 620, 622, 624, 626, 628, 630, 632, 634, and 636. As they interweave, each bottom MD yarn follows an "over 4/under 1/over 3/under 1" weave pattern relative to the bottom CMD yarns, with adjacent bottom MD yarns being offset from one another by two bottom CMD yarns.

It should be understood that all of the embodiments of FIGS. 8 through 10 will include a top layer that is stitched to the illustrated bottom layer; the top layer and stitching yarns are omitted herein for clarity.

Figure 11:
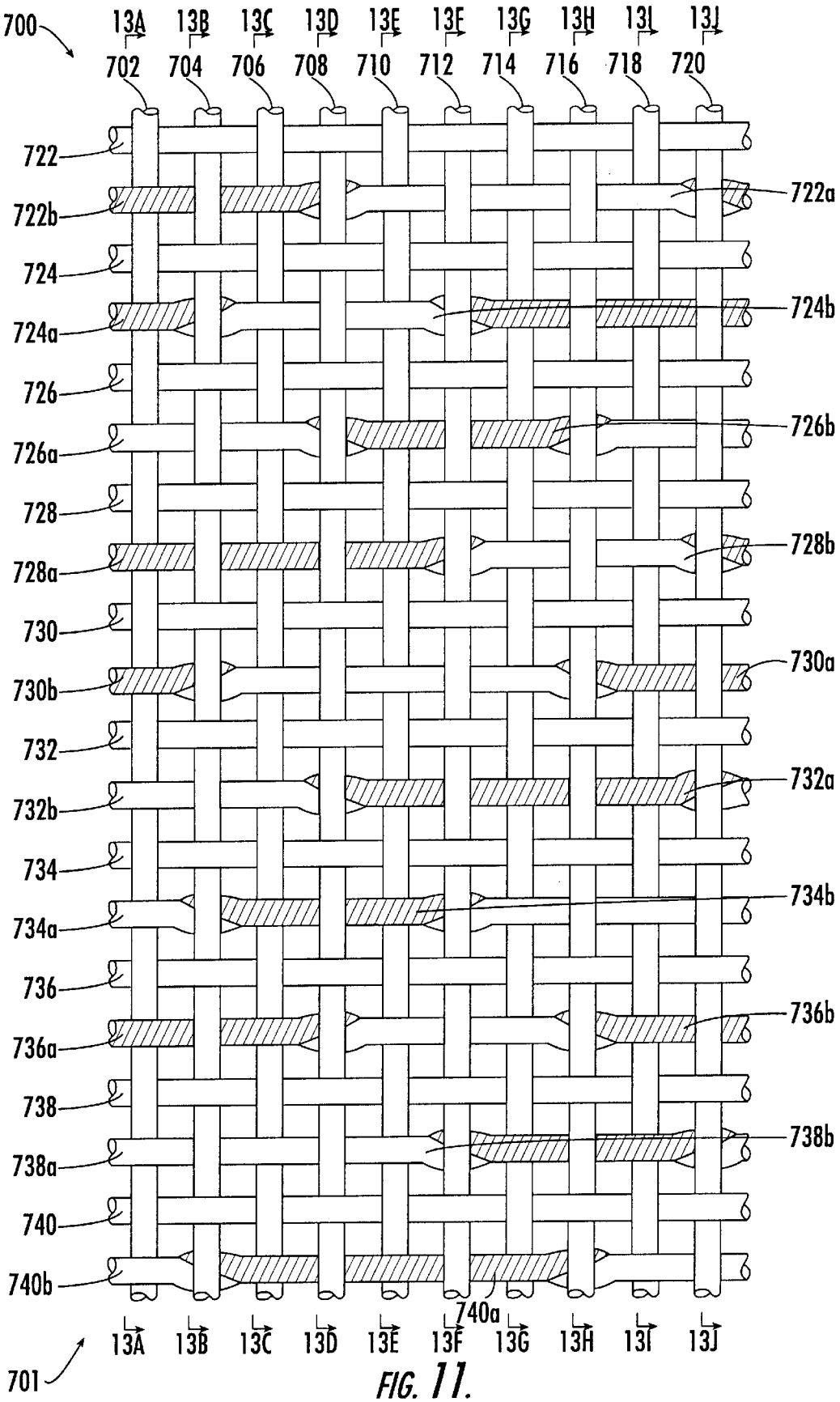
FIG. 11 is a top view of a triple layer forming fabric of the present invention.
Figure 12:
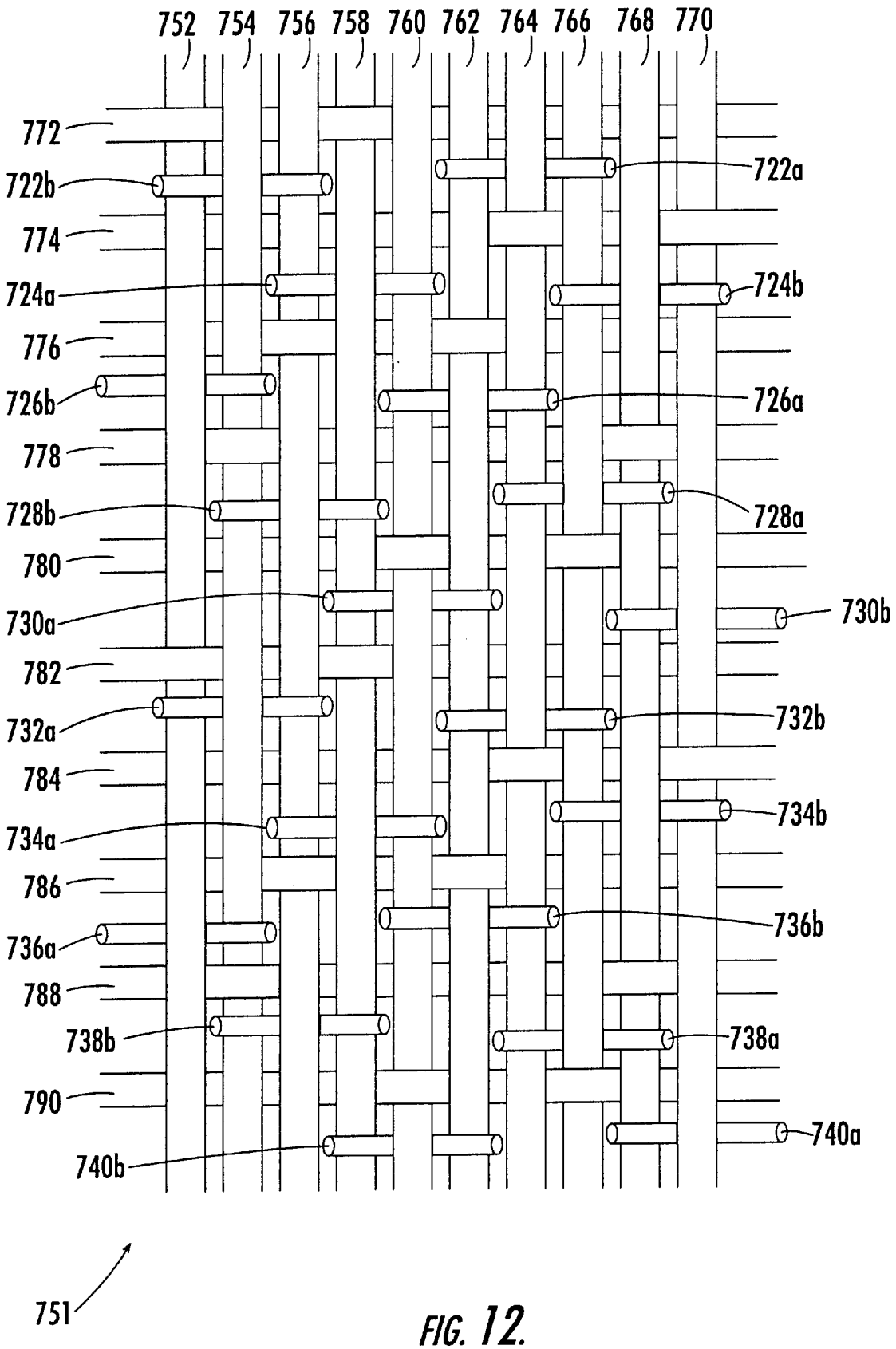
FIG. 12 is a top section view of the fabric of FIG. 11 with the top layer removed.
Figure 13A:
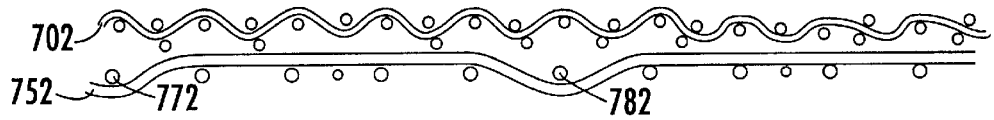
FIGS. 13A–13J are section views taken along the lines of 13A—13–A13J—13J of FIG. 11.
Figure 13B:
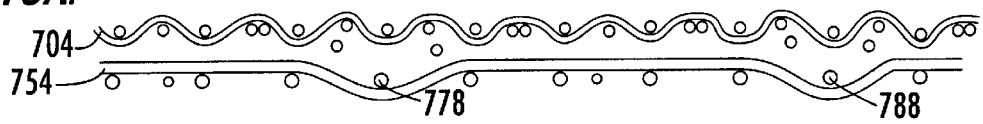
Figure 13C:
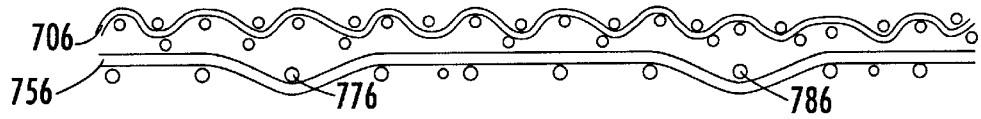
Figure 13D:
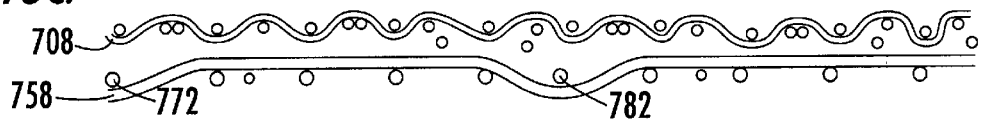
Figure 13E:
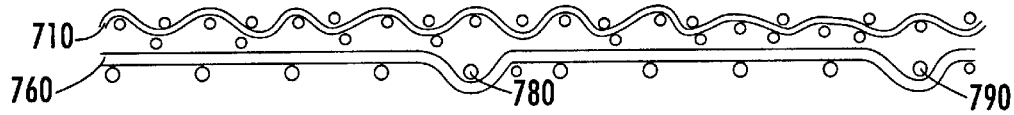
Figure 13F:
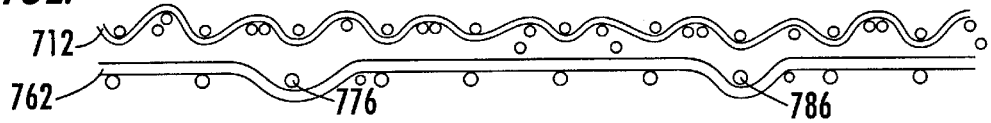
Figure 13G:
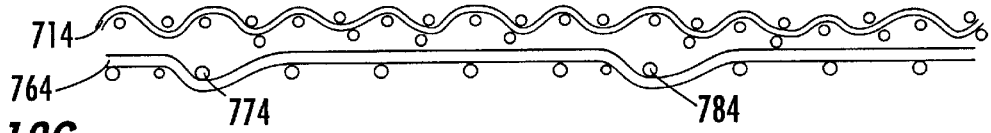
Figure 13H:
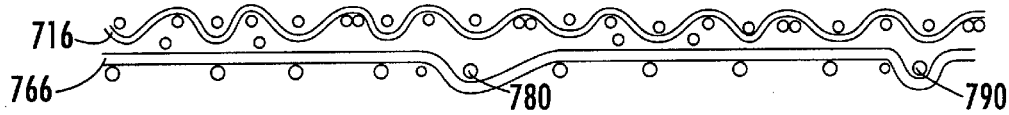
Figure 13I:
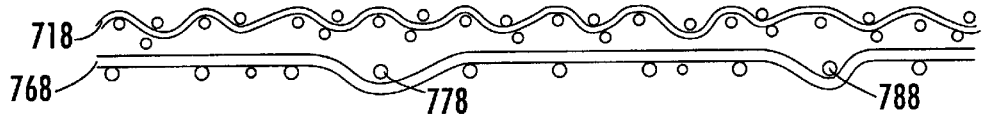
Figure 13J:
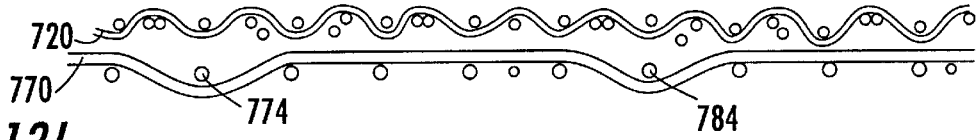

Another embodiment of a triple layer fabric of the present invention, designated broadly at 700, is illustrated in FIGS. 11–13. The fabric 700 includes a top layer 701 and a bottom layer 751. The upper layer 701 includes ten top MD yarns 702, 704, 706, 708, 710, 712, 714, 716, 718 and 720 interwoven with ten top CMD yarns 722, 724, 726, 728, 730, 732, 734, 736, 738 and 740. In addition, ten pairs of stitching yarns, designated herein as pairs 722*a*, 722*b*, 724*a*, 724*b*, 726*a*, 726*b*, 728*a*, 728*b*, 730*a*, 730*b*, 732*a*, 732*b*, 734*a*, 734*b*, 736*a*, 736*b*, 738*a*, 738*b* and 740*a*, 740*b* are also interwoven with the top MD yarns to form a plain weave papermaking surface like that illustrated in FIG. 1.

Referring now to FIG. 12, the bottom layer 751 includes ten bottom MD yarns 752, 754, 756, 758, 760, 762, 764, 766, 768, 770, interwoven with ten bottom CMD yarns 772, 774, 776, 778, 780, 782, 784, 786, 788 and 790. The bottom MD yarns are interwoven with the bottom CMD yarns in an "under 1/over 4/under 1/over 4" repeat pattern. The weaving pattern for adjacent bottom MD yarns is such that each bottom MD yarn is offset from one adjacent bottom MD yarn by two bottom CMD yarns, and is offset from its other adjacent bottom MD yarn by one bottom CMD yarn. For example, bottom MD yarn 752 passes below bottom CMD yarns 772 and 782. Adjacent bottom MD yarn 754 passes below bottom CMD yarns 778 and 788, so bottom MD yarn 754 is offset from bottom MD yarn 752 by two bottom CMD yarns (ije., a bottom MD knuckle moves from bottom CMD yarn 782 to 778). On the other side of bottom MD yarn 752, bottom MD yarn 770 passes below bottom CMD yarns 774 and 784, so it is offset from bottom MD yarn 752 by one bottom CMD yarn (i.e., a bottom MD knuckle moves from bottom CMD yarn 772 to 774).

The resulting pattern of the bottom layer 751 is such that the bottom MD knuckles are separated from one another by two bottom MD yarns. As a result, they may be in sufficient proximity to one another to induce the crimping described for the embodiments of FIGS. 1–10. As such, the fabric 700 may enjoy the same performance advantages attributable to the embodiment described in relation to FIGS. 1–10.

Those skilled in this art will recognize that other fabric embodiments can be conceived which incorporate the configuration of the fabric 700; i.e., that in which bottom layer MD knuckles passing under a common bottom CMD yarn are separated by two bottom MD yarns. For example, some of the fabrics may be woven on 16, 18, 20, 22 or even 24 harnesses and utilize the configuration found in fabrics of the present invention. Also, as noted above, the top fabric layer 701 may take other patterns such as a twill, broken twill or satin, and still be suitable for use with the present invention.

Although illustrated embodiments employ plain weave pattern top layers, the fabrics of the present invention may also employ other top layer weave patterns; for example, twills, satins, broken twills, and the like may also be employed. The stitching yarns may comprise an integral portion of the top surface weave or may not. Further, stitching yarns that are not arranged as stitching yarn pairs may also be employed in the fabrics of the present invention; examples of such stitching yarns are illustrated in U.S. Pat. Nos. 4,987,929 and 5,518,042 to Wilson, 4,989,647 to Marchand, U.S. Pat. No. 5,052,448 to Givin, U.S. Pat. No. 5,437,315 to Ward, U.S. Pat. No. 5,564,475 to Wright, U.S. Pat. No. 5,152,326 to Vohringer, U.S. Pat. No. 4,501,303 to Osterberg, and U.S. Pat. No. 5,238,536 to Danby, the disclosures of each of which are hereby incorporated herein in their entireties.

The form of the yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermaker's fabric. For example, the yarns may be formed of cotton, wool, polypropylene, polyester, aramid, nylon, or the like. The skilled artisan should select a yarn material according to the particular application of the final fabric. In particular, round monofilament yarns formed of polyester or nylon are preferred.

Yarn sizes should also be selected according to the desired papermaking properties of the fabric. Generally, top MD yarns have a diameter of between about 0.13 mm and 0.27 mm, top CMD yarns have a diameter of between about 0.13 mm and 0.30 mm, stitching yarns have a diameter of between about 0.11 mm and 0.25 mm, bottom MD yarns have a diameter of between about 0.17 mm and 0.35 mm, and bottom CMD yarns have a diameter of between about 0.20 mm and 1.0 mm. It should be noted that, because the fabrics of the present invention can employ larger than typical bottom CMD yarns, the ratio of diameter of bottom CMD yarn to bottom MD yarn can be from about 1:1 to 2.5:1. Preferably, top MD yarns have a diameter of between about 0.13 mm and 0.17 mm, top CMD yarns have a diameter of between 0.13 mm and 0.20 mm, stitching yarns have a diameter of between about 0.1 mm and 0.20 mm, bottom MD yarns have a diameter of between about 0.7 mm and 0.25 mm, and bottom CMD yarns have a diameter of between about 0.20 mm and 0.60 mm.

The foregoing embodiments are illustrative of the present invention, and are not to be construed as limiting thereof. The invention is defined by the following claims, with equivalents of the claims to be included therein.

That which is claimed is:

1. A triple layer papermaker's fabric, comprising:

a set of top machine direction yarns;

a set of top cross machine direction yarns interwoven with said top machine direction yarns to form a top fabric layer;

a set of bottom machine direction yarns;

a set of bottom cross machine direction yarns interwoven with said bottom machine direction yarns to form a bottom fabric layer;

a plurality of stitching yarns interwoven with said top and bottom fabric layers;

wherein said bottom machine direction yarns and said bottom cross machine direction yarns are interwoven in a series of repeat units in which said bottom machine direction yarns pass below two nonadjacent bottom cross machine direction yarns to form bottom machine direction knuckles, and in which pairs of bottom machine direction yarns separated from one another by one or two bottom machine direction yarns form bottom machine direction knuckles under a common bottom cross machine direction yarn.

2. The triple layer fabric defined in claim 1, wherein said top machine direction yarns, said top cross machine yarns, and said stitching yarns are interwoven to form a plain weave papermaking surface.

3. The triple layer fabric defined in claim 1, wherein said pairs of bottom machine direction yarns forming bottom machine direction knuckles under a common bottom cross machine direction yarn are separated from one another by one bottom machine direction yarn.

4. The triple layer fabric defined in claim 1, wherein said pairs of bottom machine direction yarns forming bottom machine direction knuckles under a common bottom cross machine direction yarn are separated from one another by two bottom machine direction yarns.

5. The triple layer fabric defined in claim 1, wherein said nonadjacent bottom cross machine direction yarns are separated from each other by between one and three bottom cross machine direction yarns.

6. The triple layer fabric defined in claim 5, wherein said set of bottom cross machine direction yarns in said repeat unit comprises ten bottom cross machine direction yarns.

7. The triple layer fabric defined in claim 1, wherein said repeat unit comprises equal numbers of top cross machine direction yarns and bottom cross machine direction yarns.

8. The triple layer fabric defined in claim 1, wherein said repeat unit comprises stitching yarns arranged in pairs between adjacent top cross machine direction yarns.

9. The triple layer fabric defined in claim 8, wherein said repeat unit comprises equal numbers of top cross machine direction yarns and stitching yarn pairs.

10. The triple layer fabric defined in claim 9, wherein said repeat unit comprises twice as many top cross machine direction yarns as stitching yarn pairs.

11. The triple layer fabric defined in claim 1, wherein said set of bottom machine direction yarns in said repeat unit includes ten bottom machine direction yarns, and said nonadjacent bottom cross machine direction yarns are separated from one another by three bottom cross machine direction yarns.

12. The triple layer fabric defined in claim 1, wherein said set of bottom machine direction yarns in said repeat unit includes eight bottom machine direction yarns, and said nonadjacent bottom cross machine direction yarns are separated from one another by three bottom cross machine direction yarns.

13. The triple layer fabric defined in claim 1, wherein said set of bottom machine direction yarns in said repeat unit includes twelve bottom machine direction yarns, and said nonadjacent bottom cross machine direction yarns are separated from one another by one bottom cross machine direction yarn.

14. The triple layer fabric defined in claim 1, wherein said set of bottom machine direction yarns in said repeat unit includes ten bottom machine direction yarns, and said nonadjacent cross machine direction yarns are separated from one another by three bottom cross machine direction yarns.

15. The triple layer fabric defined in claim 1, wherein said bottom machine direction yarns have a first diameter, and said bottom cross machine direction yarns have a second diameter, and wherein the ratio between said second and first diameters is between about 1:1 and 2.5:1.

16. A triple layer papermaker's fabric, comprising:

a set of top machine direction yarns;

a set of top cross machine direction yarns interwoven with said top machine direction yarns to form a top fabric layer;

a set of bottom machine direction yarns;

a set of bottom cross machine direction yarns interwoven with said bottom machine direction yarns to form a bottom fabric layer;

a plurality of stitching yarns interwoven with said top and bottom fabric layers;

wherein said bottom machine direction yarns and said bottom cross machine direction yarns are interwoven in a series of repeat units in which said bottom machine direction yarns pass below two nonadjacent bottom cross machine direction yarns to form bottom machine direction knuckles, and in which pairs of bottom machine direction yarns separated from one another by one bottom machine direction yarn form bottom machine direction knuckles under a common bottom cross machine direction yarn.

17. The triple layer fabric defined in claim 16, wherein said top machine direction yarns, said top cross machine yarns, and said stitching yarns are interwoven to form a plain weave papermaking surface.

18. The triple layer fabric defined in claim 16, wherein said nonadjacent bottom cross machine direction yarns are separated from each other by between one and three bottom cross machine direction yarns.

19. The triple layer fabric defined in claim 18, wherein said set of bottom cross machine direction yarns in said repeat unit comprises ten bottom cross machine direction yarns.

20. The triple layer fabric defined in claim 16, wherein said repeat unit comprises equal numbers of top cross machine direction yarns and bottom cross machine direction yarns.

21. The triple layer fabric defined in claim 16, wherein said repeat unit comprises stitching yarns arranged in pairs between adjacent top cross machine direction yarns.

22. The triple layer fabric defined in claim 21, wherein said repeat unit comprises equal numbers of top cross machine direction yarns and stitching yarn pairs.

23. The triple layer fabric defined in claim 21, wherein said repeat unit comprises twice as many top cross machine direction yarns as stitching yarn pairs.

24. The triple layer fabric defined in claim 16, wherein said set of bottom machine direction yarns in said repeat unit includes ten bottom machine direction yarns, and said nonadjacent bottom cross machine direction yarns are separated from one another by three bottom cross machine direction yarns.

25. The triple layer fabric defined in claim 16, wherein said set of bottom machine direction yarns in said repeat unit includes eight bottom machine direction yarns, and said nonadjacent bottom cross machine direction yarns are separated from one another by three bottom cross machine direction yarns.

26. The triple layer fabric defined in claim 16, wherein said set of bottom machine direction yarns in said repeat unit includes twelve bottom machine direction yarns, and said nonadjacent bottom cross machine direction yarns are separated from one another by one bottom cross machine direction yarn.

27. The triple layer fabric defined in claim 16, wherein said set of bottom machine direction yarns in said repeat unit includes ten bottom machine direction yarns, and said nonadjacent cross machine direction yarns are separated from one another by three bottom cross machine direction yarns.

28. The triple layer fabric defined in claim 16, wherein said bottom machine direction yarns have a first diameter, and said bottom cross machine direction yarns have a second diameter, and wherein the ratio between said second and first diameters is between about 1:1 and 2.5:1.

29. A triple layer papermaker's fabric, comprising:

a set of top machine direction yarns;

a set of top cross machine direction yarns interwoven with said top machine direction yarns to form a top fabric layer;

a set of bottom machine direction yarns;

a set of bottom cross machine direction yarns interwoven with said bottom machine direction yarns to form a bottom fabric layer;

a plurality of stitching yarns interwoven with said top and bottom fabric layers;

wherein said bottom machine direction yarns and said bottom cross machine direction yarns are interwoven in a series of repeat units in which said bottom machine direction yarns pass below two nonadjacent bottom cross machine direction yarns to form bottom machine direction knuckles, and in which pairs of bottom machine direction yarns separated from one another by one or two bottom machine direction yarns form bottom machine direction knuckles under a common bottom cross machine direction yarn;

and wherein said top machine direction yarns, said top cross machine yarns, and said stitching yarns are interwoven to form a plain weave papermaking surface.

* * * * *